US008438976B2

(12) United States Patent
Levanon et al.

(10) Patent No.: US 8,438,976 B2
(45) Date of Patent: May 14, 2013

(54) AUTOMATIC ADJUSTMENT OF PRINTER DRUM SPACING

(75) Inventors: David Levanon, Rishon Le Zion (IL); Ilan Frydman, Rishon Le Zion (IL); Yury Alioshin, Rishon Le Zion (IL); Shai Lior, Rehovot (IL); Boaz Tagansky, Rishon Le Zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 720 days.

(21) Appl. No.: 12/444,375

(22) PCT Filed: Oct. 5, 2006

(86) PCT No.: PCT/US2006/038968

§ 371 (c)(1),
(2), (4) Date: Feb. 25, 2010

(87) PCT Pub. No.: WO2008/041986

PCT Pub. Date: Apr. 10, 2008

(65) Prior Publication Data

US 2010/0288146 A1 Nov. 18, 2010

(51) Int. Cl.
*B41F 1/54* (2006.01)

(52) U.S. Cl.
USPC ..... 101/484; 101/216; 101/247; 101/485

(58) Field of Classification Search ..... 101/216, 101/247, 484, 485
See application file for complete search history.

(56) References Cited

U.S. PATENT DOCUMENTS

| | | | | |
|---|---|---|---|---|
| 4,527,473 | A * | 7/1985 | Littleton | 101/220 |
| 5,275,099 | A * | 1/1994 | Kawagoe | 101/216 |
| 5,966,559 | A | 10/1999 | May | |
| 6,404,999 | B1 | 6/2002 | Shoji | |
| 2006/0011817 | A1 | 1/2006 | Harush | |

FOREIGN PATENT DOCUMENTS

| | | |
|---|---|---|
| JP | 05-197296 | 8/1993 |
| JP | 2002-365968 | 12/2002 |
| JP | 2003-106329 | 4/2003 |

OTHER PUBLICATIONS

International Search Report; PCT Patent Application No. PCT/US2006/038968, filed Oct. 5, 2006; search issued by European Patent Office (ISA) Jul. 23, 2007.

* cited by examiner

*Primary Examiner* — Ren Yan

(57) ABSTRACT

A method is presented for automatically controlling the spacing between printer drums. The printer includes at least two print drums (920.1, 920.2) whose parallel rotation leads to image transfer, either between the drums or onto a printed surface. First the pressure a signal indicative of the pressure between the two print drums is obtained by a measurement unit (930), and then the gap between the drums is automatically adjusted in accordance with the indicator signal by a gap adjuster (940).

15 Claims, 13 Drawing Sheets

AUTOMATIC ADJUSTMENT OF PRINTER DRUM SPACING

FIELD AND BACKGROUND OF THE INVENTION

The present invention relates to automatically adjusting the relative positioning of two printer drums based on a determined level of contact between the drums and, more particularly, but not exclusively to adjusting the positioning of drums of an electrophotographic printer.

Many forms of printing rely on a printing drum whose rotation transfers an image from the drum to a printed substrate. More advanced forms of printing, such as electrophotographic printing, utilize parallel pairs of drums whose joint rotation transfers the image either from one drum to the next, or from one drum to a substrate supported by another drum. Electrophotographic printing machines generally use a two-transfer system of printing in which an electrophotographic image is formed on a first drum (known as the PIP drum) using a laser beam shone onto a photoelectric material, thereby forming an electrostatic image on the photoelectric material. Ink is then drawn into the electrostatic image. The image so formed is then transferred in a first transfer operation onto a blanket carried by an intermediate transfer drum, known as the ITM drum. A second transfer operation occurs when the image is transferred from the blanket onto the printing substrate which is held on a third drum, known as the impression drum.

Referring now to the drawings, FIG. 1 schematically illustrates a cross sectional view of an electrostatic printing assembly 1, according to the teaching of prior art. Apparatus 1 comprises an electrostatic drum 10 (also denoted herein the PIP drum) arranged for rotation about an axle 12. Drum 10 is typically formed with an imaging surface 16, e.g., a photoconductive surface. Surface 16 is typically of a cylindrical shape.

A charging unit 18, which can be a corotron, a scorotron, a roller charger or any other suitable charging unit known in the art, uniformly charges surface 16, for example, with positive charge.

Continued rotation of the drum 10 brings surface 16 into image receiving relationship with an exposing unit 20, which focuses one or more scanning laser beams onto surface 16 to scan a desired image. The laser beams selectively discharge surface 16 in the areas struck by light, thereby forming an electrostatic latent image. Usually, the desired image is discharged by the light while the background areas are left electrostatically charged. Thus, the latent image normally includes image areas at a first electrical potential and background areas at another electrical potential. Unit 20 may be a modulated laser beam scanning device, an optical focusing device or any other imaging device known in the art.

Continued rotation of the drum 10 brings imaging surface 16, now bearing the electrostatic latent image, into a developing unit 22, which typically comprises electrodes 24 that apply a liquid toner or ink on surface 16, so as to develop the electrostatic latent image. The liquid toner can comprise charged solid particulates dispersed in a carrier liquid. The solid particulates are typically charged to the same polarity as the photoconductor. Thus, due to electrostatic repulsion forces, ink particles adhere to areas on the photoconductor corresponding to the image regions, substantially without adhering to, and thus developing, the background regions. In this manner a developed image is formed on surface 16.

Following application of liquid toner thereto, surface 16 typically passes through other rollers (not shown) which ensure that the ink surface is appropriate for transfer to ITM drum 40. A first ink transfer then occurs, in which the liquid image is transferred, typically via electrostatic attraction, from drum 10 to ITM drum 40, rotating in the opposite direction of drum 10. In order for the first transfer to occur, an electrical bias is needed in the direction of image transfer. The drums are therefore generally biased by a bias unit, so that a forward bias leads from electrostatic drum 10 to ITM drum 40.

Subsequently, the image experiences a second transfer, typically aided by heat and pressure, from ITM drum 40 to a substrate 42, which is supported by an impression drum 43.

Following the transfer of the liquid image to ITM drum 40, imaging surface 16 is cleaned to remove ink traces. Residual charge left on surface 16 can be removed, e.g., by flooding surface 16 with light from a lamp 58.

In electrophotographic printing, print quality and overall machine performance are both highly dependent on the pressure between the drums and on the parallel alignment of the drums. This problem also appears in conventional printing presses, and other equipment that need smooth rotation of two cylinders with precisely controlled gap. The first transfer pressure (i.e. between the PIP and the ITM drums) contributes to several print quality parameters including:

(a) Small (single and double pixel) dots transfer (b) Solid quality (fog and small voids in solid ink layer)

(c) Quality of horizontal lines (d) Short Term Memory (STM) and wetness (e) Banding, especially on gray portions of the image and horizontal lines (f) Background transfer An improper first transfer pressure can also degrade overall machine performance parameters by:

(a) Decreasing the blanket lifetime (related to background transfer)

(b) Increasing the amount of ink amount per area unit (dma) and, as a result, ink consumption, reservoir filter lifetime, and fixing (c) Decreasing the PIP life span Similarly, an incorrect second transfer pressure (between the ITM drum surface and the blanket on the impression drum) can also decrease blanket life span as well as increase the possibility of paper jams. The printing blanket and paper thickness both contribute to the second transfer pressure, so that pressure changes may be caused by inconsistent printing blanket thickness.

One method of reducing banding on print is to use bearers to fix the gap between two drums. Bearers are rigid shoulders on each cylinder with a diameter slightly larger than the center of cylinder. However, the bearers create a fixed gap which cannot compensate for changes in blanket thickness or other changes. Therefore the pressure between the plate and blanket may not be optimal, leading to deficiencies in image quality of the print.

Currently the inter-drum pressure is commonly adjusted manually. Typically, images are first printed at different pressures. An operator then visually inspects the resulting printed pages, and selects the correct pressure on the basis of the visual analysis. For example, the operator can insert an underpacking material below the blanket and\or plate to compensate for such changes. This requires high-skilled manual operation, extra materials, and is hard to implement. An alternate solution is to use conical shaped bearers and to control the axial alignment of the cylinders. However, designing a drum with conical bearers is complicated and increases the hardware costs of the press. Additionally, the axial movement requires printer elements to be a little wider in order to compensate for the varying printing width. In another solution, the PIP drum position is adjusted by running motors, based on the type of print medium selected by the operator. This method requires operator input and is therefore prone to human error. Furthermore, positioning the print drum for a particular print medium does not account for other factors, such as material tolerances, temperature variations, and so forth.

In summary, the current methods for ensuring correct transfer pressures suffer from several disadvantages. The process is operator dependent, yielding a difference in pressure between customers, and in many cases is not even performed. Even when performed, the adjustment process is generally not of high enough precision, so that the best possible performance is not always obtained. Additionally, since the pressure changes during printing, adjusting the pressure before printing does not ensure that the pressure is optimal during printing.

There is thus a widely recognized need for, and it would be highly advantageous to have, an apparatus and method for controlling the pressure between drums devoid of the above limitations.

SUMMARY OF THE INVENTION

According to a first aspect of the present invention there is provided a method for automatically controlling the spacing between printer drums. The printer includes at least two print drums whose parallel rotation leads to image transfer, either between the drums or onto a printed surface. First a pressure signal indicative of the pressure between the two print drums is obtained, and then the gap between the drums is automatically adjusted in accordance with the indicator signal.

According to a second aspect of the present invention there is provided a printer with automatic drum spacing adjustment. The printer includes a first and a second drum arranged for image transfer by parallel rotation, a measurement unit which obtains an indicator signal indicative of a pressure between the drums, and a gap adjuster associated with the measurement unit, which adjusts a gap between the drums in accordance with the indicator signal.

According to a third aspect of the present invention there is provided a drum spacing controller, for a drum assembly which includes a first and a second drum arranged for parallel rotation. The controller includes a potential applier which applies an electrical potential between the first and second drums, a current monitor which measures a current between the drums as a separation between the drums is reduced, and a control unit associated with the current monitor, which controls a spacing of the drums in accordance with a derivative of the measured current.

According to a fourth aspect of the present invention there is provided a drum spacing controller, for a drum assembly which includes a first and a second drum arranged for parallel rotation. The first drum has elevated shoulders thermally isolated from a center of the first drum. The drum spacing controller includes a control unit which controls a temperature differential between the shoulder and the center of the first drum, in accordance with a specified gap between the drums, and a thermal element associated with the control unit, which adjusts a temperature differential between the shoulder and the center of the first drum so as to obtain a required height difference between the shoulders and the center of the first drum.

According to a fifth aspect of the present invention there is provided a drum spacing controller, for a drum assembly which includes a first and a second drum arranged for parallel rotation. The first drum including a central portion and elevated shoulders, where the shoulders and the center have different thermal expansion coefficients. The drum spacing controller includes a control unit which controls a temperature of the first drum, in accordance with a specified gap between the drums, and a thermal element associated with the control unit, which adjusts a spacing of the first and second drums by adjusting a temperature of the first drum so as to obtain a required height difference between the shoulders and the center of the first drum.

According to a sixth aspect of the present invention there is provided a printer with adjustable drum spacing. The printer includes a first and a second drum arranged for image transfer by parallel rotation, and a first and a second electric motors associated with the first drum for adjusting the positions of respective ends of the first drum.

According to a seventh aspect of the present invention there is provided a pressure adjustment apparatus which automatically adjusts pressure between two revolving drums. The pressure adjustment apparatus includes at least one measuring device located to provide an indicator signal indicative of a pressure between the two drums, at least one actuator which varies a gap between the drums thereby to effect pressure between the drums, and feedback circuitry connected between the at least one measuring device and the at least one actuator. The feedback circuitry is operative to receive the indicator signal from the measuring device and to output a signal to the at least one actuator, thereby to control the actuator such that the pressure exerted is controllable.

The present invention successfully addresses the shortcomings of the presently known configurations by providing a printer capable of automatically adjusting the spacing between print drums to obtain a desired gap or pressure without operator intervention.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

Implementation of the method and system of the present invention involves performing or completing selected tasks or steps manually, automatically, or a combination thereof. Moreover, according to actual instrumentation and equipment of embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
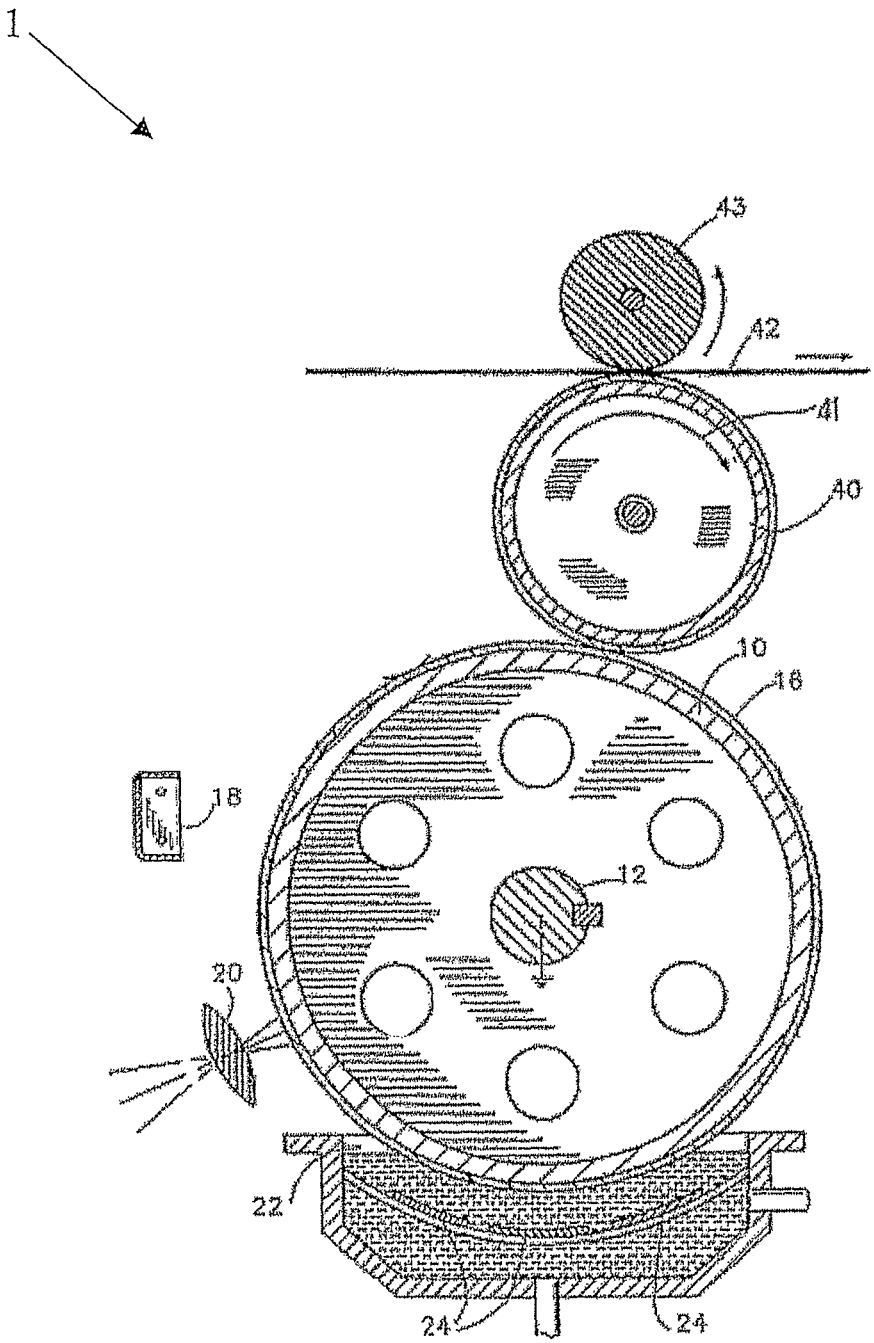
Fig. 1 (Prior Art)
FIG. 1 schematically illustrates a cross sectional view of an electrostatic printing assembly, according to the teaching of prior art.

The present embodiments teach a method for controlling the gap between two print drums, in order to ensure high quality printing. Specifically, the present embodiments teach obtaining a signal indicative of the gap between the two drums and adjusting the gap accordingly, in order to form a feedback system for controlling the first and/or second transfer pressure of an electrophotographic printer without operator intervention.

Many types of printers, including electrophotographic printers, utilize the parallel rotation of two or more drums to transfer an image from one surface to another. The pressure and alignment between the drums is critical to the resulting print quality. Currently, adjusting the relative positioning of the print drums is an operator-dependent task which is not always performed. The following embodiments are directed at automating print drum adjustment, by automatically adjusting the print drum positioning until it is determined that an adequate contact and alignment are reached.

The principles and operation of a printer with automatic print drum adjustment according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

In the following, parts that are the same as those in previous figures are given the same reference numerals and are not described again except as necessary for an understanding of the present embodiment.

The following non-limiting embodiments are directed to aligning drums which are part of a printing system. However, the embodiments described below are applicable to aligning drums of other types of systems whose material composition makes implementation of the embodiment possible.

Figure 2:
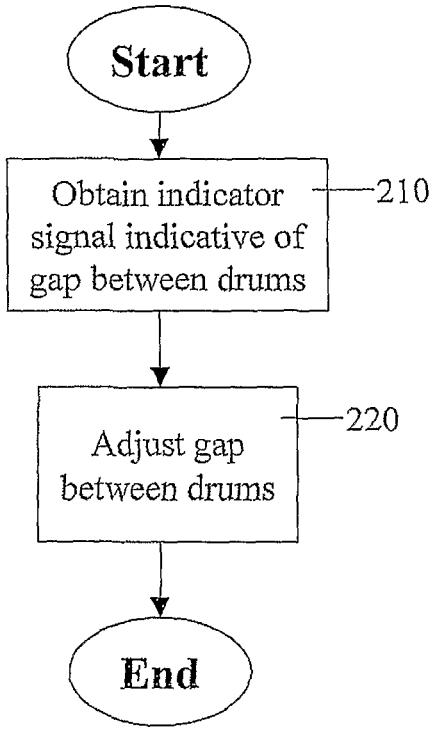
FIG. 2 is a simplified flowchart of a method for automatically controlling the spacing between drums of a printer, according to an exemplary embodiment of the present invention.

Reference is now made to FIG. 2, which is a simplified flowchart of a method for automatically controlling the spacing between drums of a printer, according to an exemplary embodiment of the present invention. The printer has two drums whose parallel rotation transfers the image from one drum to the next or from a drum to a substrate (which is supported by the second drum). The present embodiment utilizes closed-loop feedback to automatically adjust the gap between the two printer drums. Correct adjustment of the gap ensures that the transfer pressure between the drums is maintained at the required level, with no dependence on tolerances, temperatures, the type of media and the like.

The printer may be an electrophotographic printer. In a first embodiment, the method adjusts the first transfer pressure, in which case the two drums are the electrostatic (PIP) drum and the ITM drum. In an alternate embodiment, the method adjusts the second transfer pressure, in which case the two drums are the impression drum and the intermediate transfer (ITM) drum.

In step 210, a signal indicative of the pressure (i.e. force) between the two drums is obtained (denoted herein the indicator signal).

In a first embodiment, the indicator signal is obtained by creating a potential difference between the two drums and measuring the current flow between the drums, as described in more detail below. In a second embodiment, the indicator signal is obtained by measuring the pressure between the two drums by any method known in the art, for example utilizing a strain measurement element (such as a strain gage or load cell) as described below.

In step 220, the gap between the drums is adjusted automatically in accordance with the indicator signal, thus forming a feedback system which permits fine-tuning the pressure between the drums with high accuracy and without operator intervention. The adjustment may also take into account a known blanket thickness. Several non-manual methods of adjusting the gap between the rollers are discussed below.

In an exemplary embodiment, obtaining an indicator signal and/or adjusting of the drums is performed separately at each end. If the indicator signal readings differ at the two sides of the drums, the separation between the two drums may be changed by different amounts at each end in order to equalize the pressure. Thus it is possible to ensure that the two drums are working in parallel, with even pressure along all their entire length.

Following is a discussion of a first, non-limiting exemplary embodiment for measuring the pressure between two drums, which is effective for situations in which a potential difference can be created between the drums. The present embodiment is based on monitoring the current created between two drums at different potentials, as the distance between the drums is decreased. As is well known, an electric current appears when surfaces with different electric potentials are in contact. The magnitude of this current increases as the contact area between the two surfaces increases. Thus the current flow between the two drums, and in particular the rate of change of the current, is an indicator of the contact area of the two drums, and, consequently, of the pressure between the drums.

Figure 3:
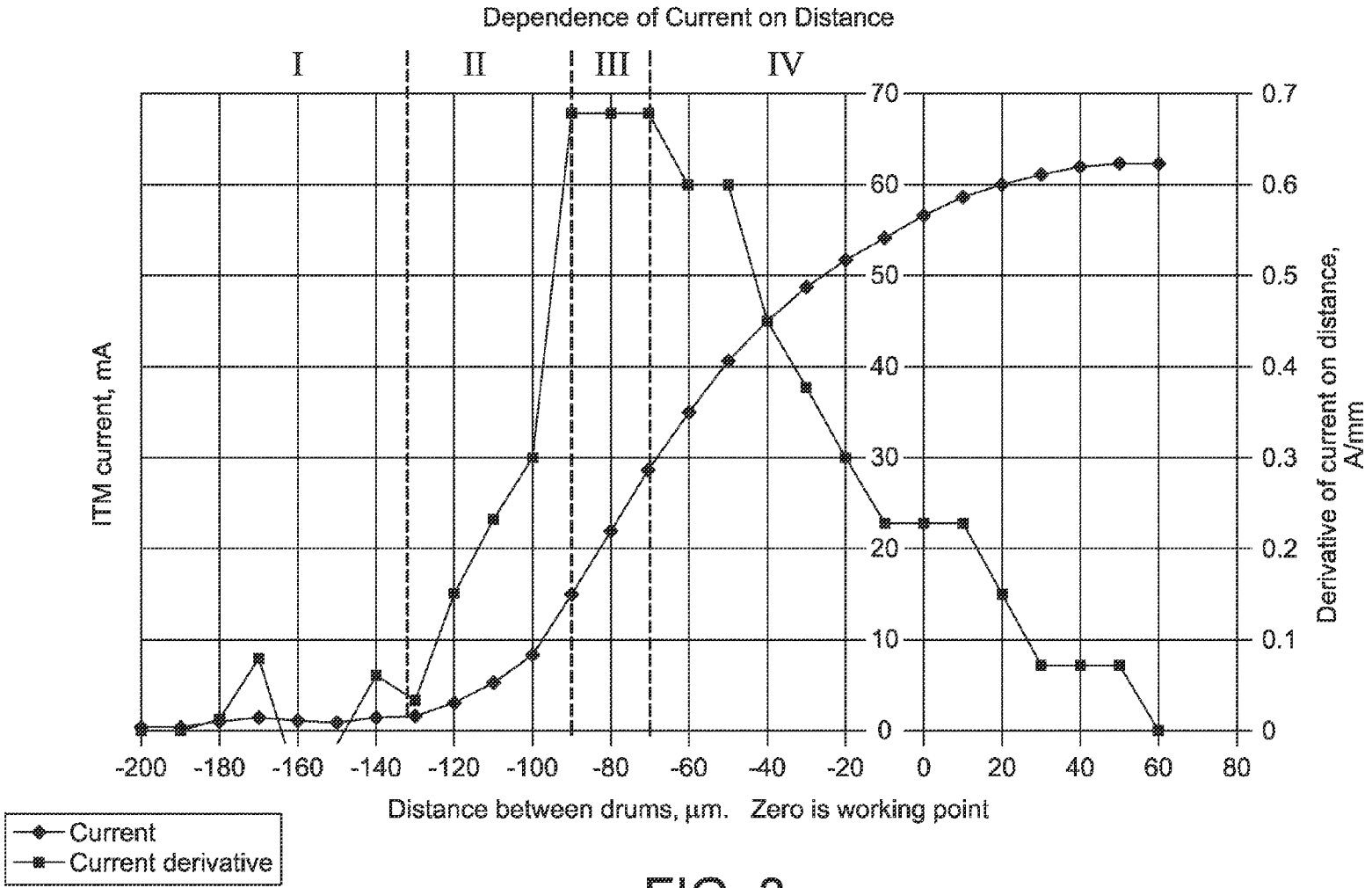
FIG. 3 is a graph illustrating the dependence of current upon distance as the distance between two drums at different potentials is decreased.

Reference is now made to FIG. 3, which is an exemplary graph illustrating the dependence of current upon distance, as the distance between two drums at different potentials is decreased. The actual current behavior, and the relationship between the value of the derivative and the actual pressure depend upon many factors, including drum geometry, step size, and surface properties. The graph gives an example illustrating typical behavior of the magnitude and the derivative (i.e. rate of change) of the current. On the graph we see four regions:

I. "No contact" region—the drums do not touch each other. The inter-drum current is low and independent of distance. The derivative is close to zero.

II. "Just touch" region—the drums begin to touch and current increases. As the distance decreases, the contact area between the drums increases rapidly. The derivative increases rapidly. At the end of this region the derivative reaches maximal value.

III. "Steady state" region—the increase of contact area with drum distance is constant. Current increases and the derivative is constant IV. "Plateau" region—the increase of contact area with drum distance is small.

Current increases very slowly, and the derivative decreases to zero.

Figure 4:
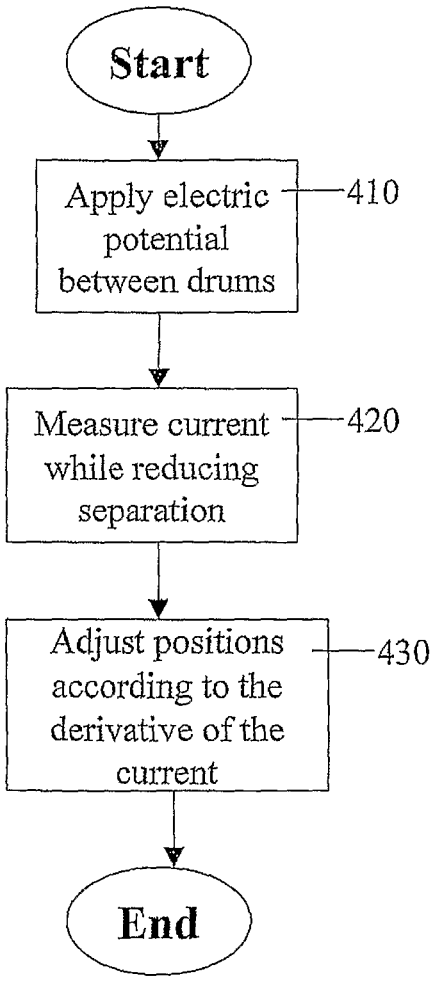
FIG. 4 is a simplified flowchart of a method for measuring the pressure between print drums, according to an exemplary embodiment of the present invention.

Reference is now made to FIG. 4 which is a simplified flowchart of a method for obtaining an indicator signal indicative of the pressure between print drums, according to an exemplary embodiment of the present invention. In the present embodiment, the derivative of the current as the distance between the drums is decreased is used to adjust drum spacing in order to yield the desired gap and/or pressure (FIG. 2, step 220). Generally the desired spacing is selected within the "Just touch" region (II), and identified when derivative reaches a specified level.

In step 410, an electrical potential is applied between the drums. In step 420, the current between the drums is measured as the separation (i.e. distance) between the drums is gradually reduced. In order to ensure that the drums are operating in region II, the drums may first be separated to avoid contact (with minimal or no current flow). As the distance is decreased, the derivative of the measured current is obtained repeatedly. The derivative is a reliable indicator of the contact between the drums, and hence the pressure. The drum positions are adjusted in step 430 in accordance with the derivative of the current. The drum spacing may be adjusted by determining when the derivative reaches or exceeds a specified value (corresponding to the desired gap or pressure), and then maintaining drum spacing at the current position. Alternately, the drums may first be set to an initial position, and then their relative positions adjusted by a specified amount from the initialized position. For example, the drums may be brought to an initial "Just touch" position. Then the distance between the print drums may be decreased by a fixed amount to provide a required blanket compression. It may not be necessary to explicitly translate the derivative value into a pressure reading.

Figure 5:
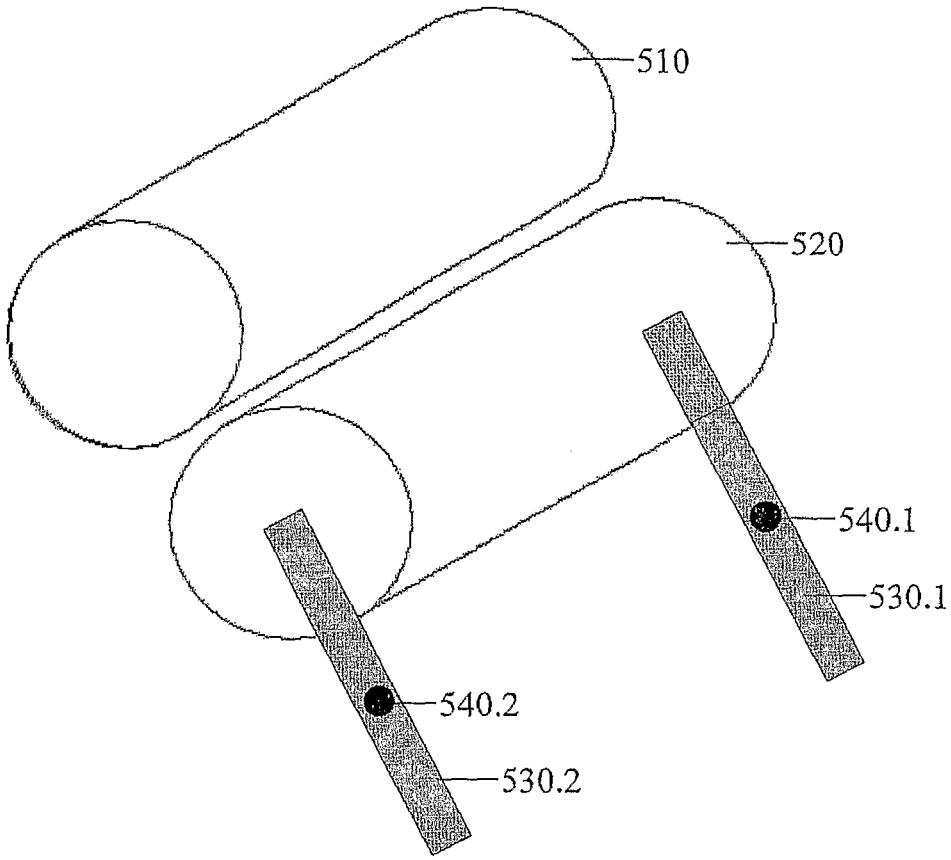
FIG. 5 is a schematic illustration of an exemplary configuration which uses strain measurement elements to measure the pressure between two print drums.
Figure 6:
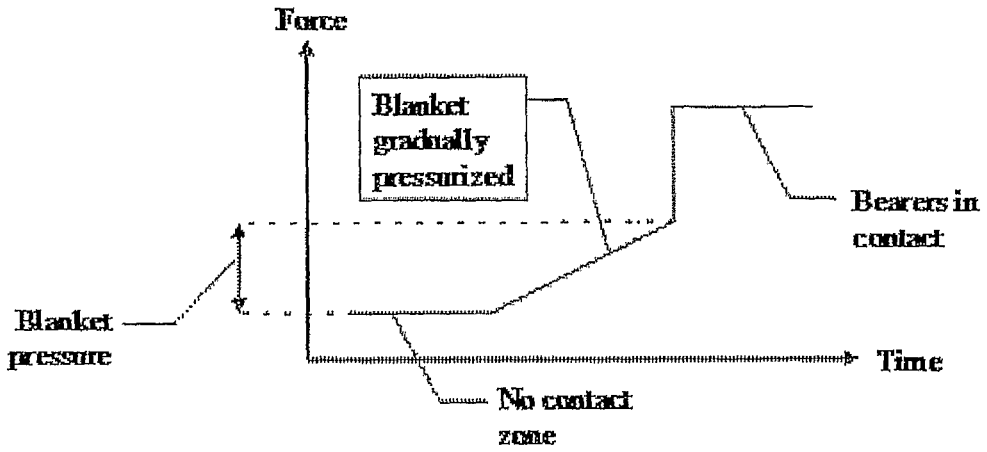
FIG. 6 is a graph illustrating the behavior of the strain gage output signal over time as the gap between the drums decreases.

In a second exemplary embodiment, the indicator signal is obtained by measuring the stress upon one or both of the arms supporting the drum. FIG. 5 is a schematic illustration of an exemplary configuration which uses strain measurement elements to measure the pressure between two print drums, 510 and 520. Print drum 520 is supported by two arms, 530.1 and 530.2, each of which has a respective strain measurement element, 540.1 and 540.2, attached. The strain measurement elements measure the force applied between the drums, as the drums are brought together. FIG. 6 is a graph illustrating the behavior of the strain measurement element output signal over time, as the gap between the drums is decreased. Three different regions may be seen on FIG. 6. At first the print drums are not in contact, and the strain measurement element output signal is minimal. When the drums first come into contact, the blanket compresses and the strain measurement element output level rises steadily and continuously. Finally, the bearers meet, and there is a discontinuous upward jump in the output level.

As in the previous embodiment, it may not be necessary to explicitly calculate the actual pressure between the drums from the strain measurement element output signal. Instead, for example, the output signal may be amplified and processed to form a feedback signal which directly adjusts the print drum spacing.

After the indicator signal has been obtained, the gap between the print drums is adjusted (FIG. 4, step 420). It is an object of the present embodiments to adjust the gap between the drums automatically, without operator intervention, on the basis of the accurate pressure measurements obtained as described above.

Figure 7:
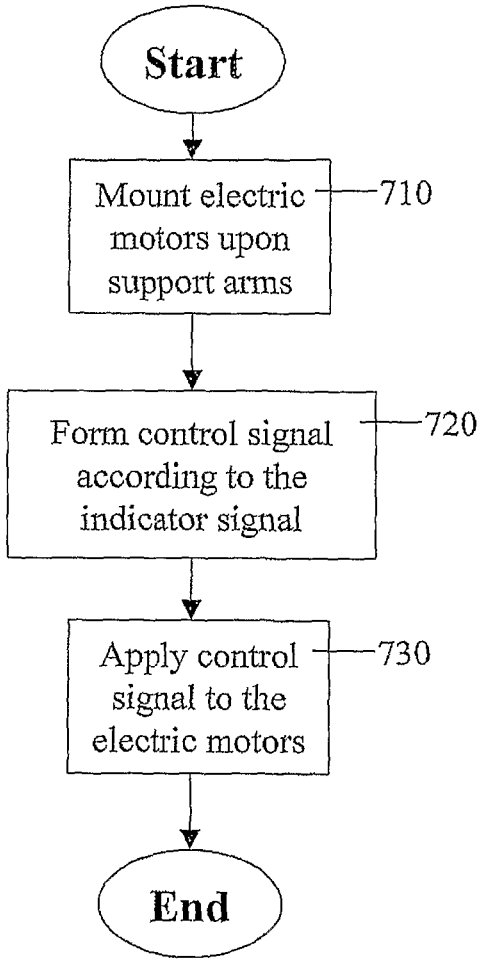
FIG. 7 is a simplified flowchart of a method for adjusting the gap between two print drums, according to an exemplary embodiment of the present invention.

Reference is now made to FIG. 7, which is a simplified flowchart of a method for adjusting the gap between two print drums, according to a first exemplary embodiment of the present invention. In step 710, electric motors are mounted upon the two support arms of one of the drums. In step 720 a control signal is formed on the basis of the indicator signal. The control signal may be derived directly from strain, current flow or other measurements, or may be generated by a digital controller. In step 730, the control signal is applied to the electric motors.

In the present embodiment, electric stepping motors are mounted on each print drum engage arm, in place of the adjustments screws which must be tightened manually. The indicator signal may be obtained from strain measurement elements that are placed on each engage arm. The strain measurement elements sense the stress on each engage arm and send it to an amplifier. For example, if the strain measurement element is a load cell, the amplifier translates the resistance change of the load cells to a current signal that is input to a digital controller which controls the stepping motors. The present embodiment may also serve as a paper jam detector.

In a second exemplary embodiment, the gap between the print drums is adjusted via thermal expansion. A common situation in printers (and other equipment) is to have two parallel drums, where the distance between them is set by bearers (also denoted herein shoulders). In such a case it is hard to control the gap, since it is fixed by the height of the bearers.

In the present embodiment the gap is adjusted by controlling the temperature of one or both of the drums, so that the difference in the expansion and contraction of the bearers vs. the center of the drum brings the centers of the two drums to the correct distance. In a first embodiment, the center and the bearers are thermally isolated, and the relative expansion is controlled by creating a temperature differential between the drum and the bearers. The temperature differential may be created by controlling the temperature(s) of the center and/or the bearers, of one or both of the drums. In a second embodiment, the center and the bearers are constructed of materials with different thermal expansion coefficients, so that the height differential between the bearers and the center varies with temperature. Currently, some printers have thermally-controlled print drums, so that the present method is easily implementable. Note that care should be taken not to change the temperature of an element whose temperature is important to the performance of the device beyond operational limits.

Figure 8:
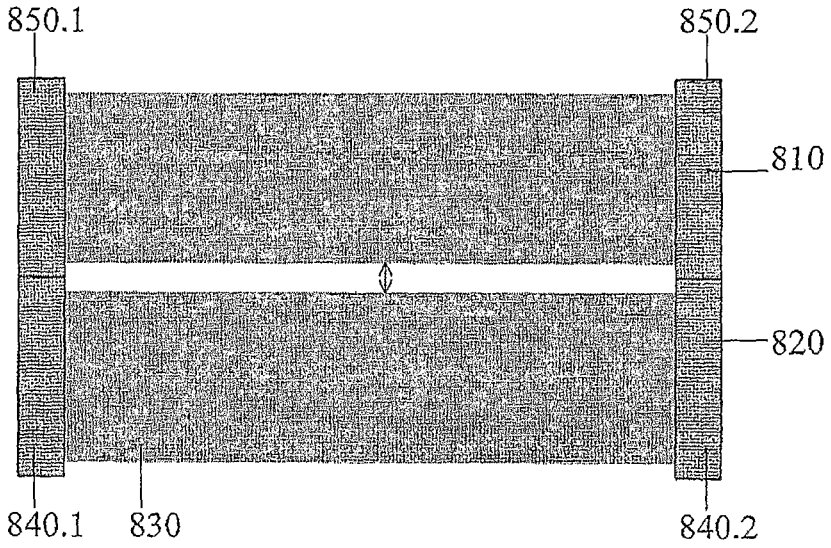
FIG. 8 illustrates two print drums with bearers, in which the print drums are pressed towards each other so that the opposing shoulders are brought into a rigid contact while some gap is maintained between the cylinders.

As shown in FIG. 8, the two drums (810 and 820) are pressed towards each other, so that the opposing shoulders (for example, 840.1 and 850.1) are brought into rigid contact while some gap is maintained between the cylinders. By controlling the temperatures of the cylinders (i.e. centers) and the shoulders one can control the diameter difference between the cylinder and shoulder. For example, consider a drum having a center made of aluminum and a shoulder made of steel, where the center and shoulders are thermally isolated from each other. Increasing the drum temperature reduces the gap between the centers of the two drums, while the shoulders are in contact. In an exemplary embodiment, an external heating device is placed over the ITM cylinder in order to control the temperature of the blanket, so that the cylinder temperature has only minimal effect on the performance of the device. In other cases it might be more useful to control the shoulder temperature. For example, a change in drum temperature by +\−12 C could change the gap by about +\−50 microns, covering the tolerance range of the blanket and drums.

In an exemplary embodiment, the required drum temperature(s) are determined from the current flow between two drums (as described for FIG. 4). The process starts with a cold drum. As the temperature-controlled portion of the drum is heated (say the center of the drum), the electrical current between the two drums is measured and a critical temperature (i.e. the temperature at which the derivative reaches a specified value) is found. Knowing the difference between the measured blanket pressure and the desired blanket pressure, the required temperature difference may be calculated.

The temperature set point may also take into account the blanket thickness, so that the procedure may be repeated less frequently (for example, once a day, but not when the blanket is replaced). A table may be derived, correlating required temperature change with blanket thickness. Blanket thickness data may be obtained from a blanket barcode, RFID, or otherwise.

Figure 9A:
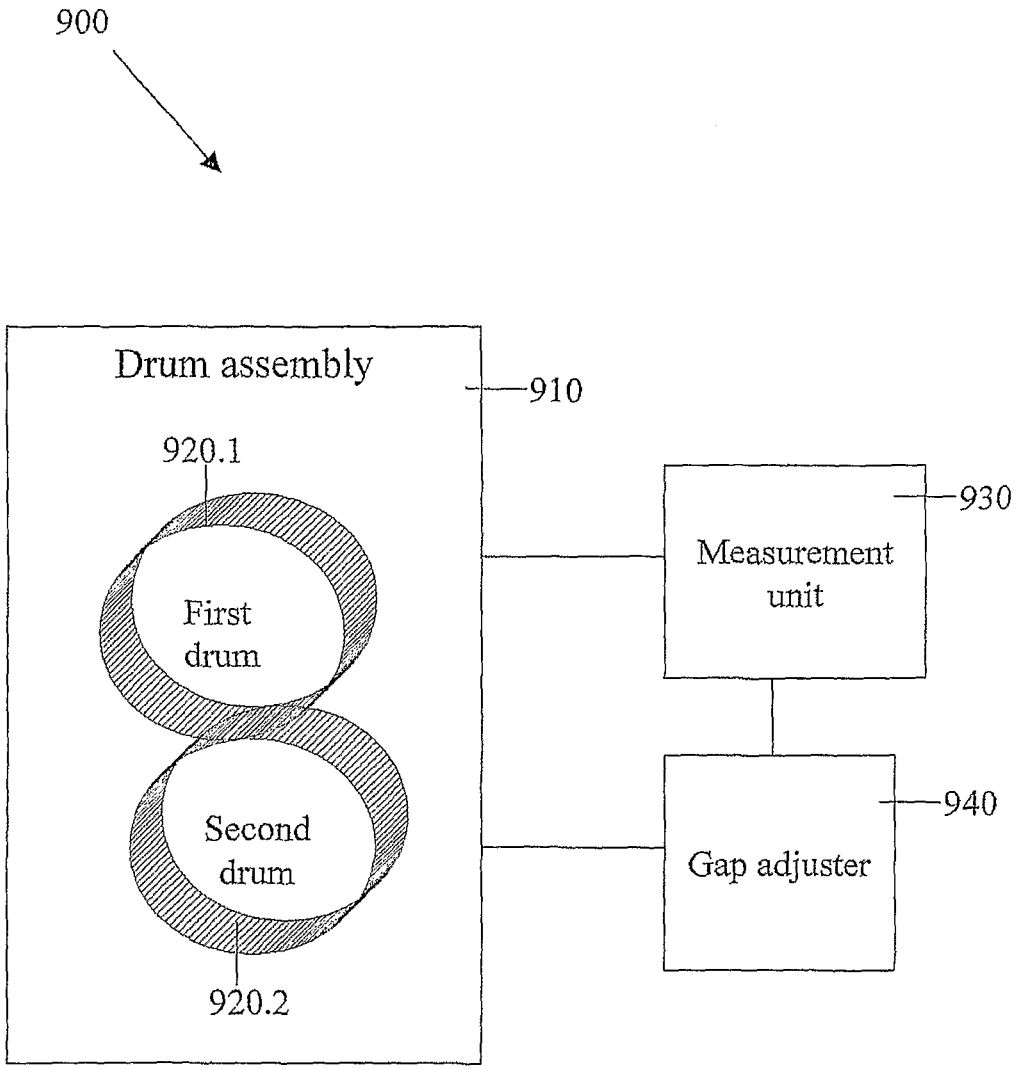
FIG. 9*a* is a simplified block diagram of a printer with automatic drum spacing adjustment, according to an exemplary embodiment of the present invention.

Reference is now made to FIG. 9*a*, which is a simplified block diagram of a printer with automatic drum spacing adjustment, according to a first exemplary embodiment of the present invention. Printer 900 includes a drum assembly 910, with two drums, 920.1 and 920.2. Printer 900 may include additional drums, for example in the configuration of an electrophotographic printer with a PIP drum, an ITM drum, and an impression drum. Measurement unit 930 obtains an indicator signal indicative of the gap between the drums. Gap adjuster 940 adjusts the gap between the drums on the basis of the indicator signal.

Measurement unit 930 may provide the indicator signal directly to gap adjuster 940, in which case gap adjuster 940 derives the necessary adjustments for the print drum. Alternately, measurement unit 930 directly controls gap adjuster 940 to obtain the necessary adjustment. The measurements may be made at the beginning of the process and then used to perform the required adjustment, or they may be performed repeatedly or continuously while gap adjustment is taking place.

In the case of an electrophotographic printer, gap adjuster 940 adjusts the gap between electrostatic drum and the ITM drum pair, and/or the gap between the impression drum and the intermediate transfer (ITM) drum pair.

Pressure measurements may be made using a strain measurement element and/or by measuring current flow between drums, as discussed above, or by any other technique known in the art. In the present embodiment where the indicator signal is derived by measuring the electrical potential between the drums, measurement unit 930 may include a potential applier which applies an electrical potential between the first and second drums, and a current monitor which measures the current between the drums as a separation between the drums is reduced. Measurement unit 930 is thus able to control gap adjustment in accordance with the derivative of the measured current, for example by signaling gap adjuster 940 when the specified derivative value has been reached.

In an alternate embodiment, where gap adjustment is performed by controlling the temperature(s) of print drums with bearers, gap adjuster 940 may include a thermal control element. In a first embodiment the drum center and bearers are thermally isolated, and the thermal control element controls the relative temperatures of the drum center and the bearers. The center temperature may be controlled, for example, by adjusting the temperature of the blanket. In a second embodiment, the shoulders and the center of the drum have different thermal expansion coefficients, and the thermal control element controls a single drum temperature.

In another embodiment, gap adjuster 940 includes two electric motors, for example stepping motors, mounted respectively upon each supporting arm of one of the drums. Gap adjuster 940 operates the electric motors based on the indicator signal and/or other control signals provided by measurement unit 930. Gap adjuster 940 may control each of the electric motors separately, so as to ensure parallelism between the drums.

Figure 9B:
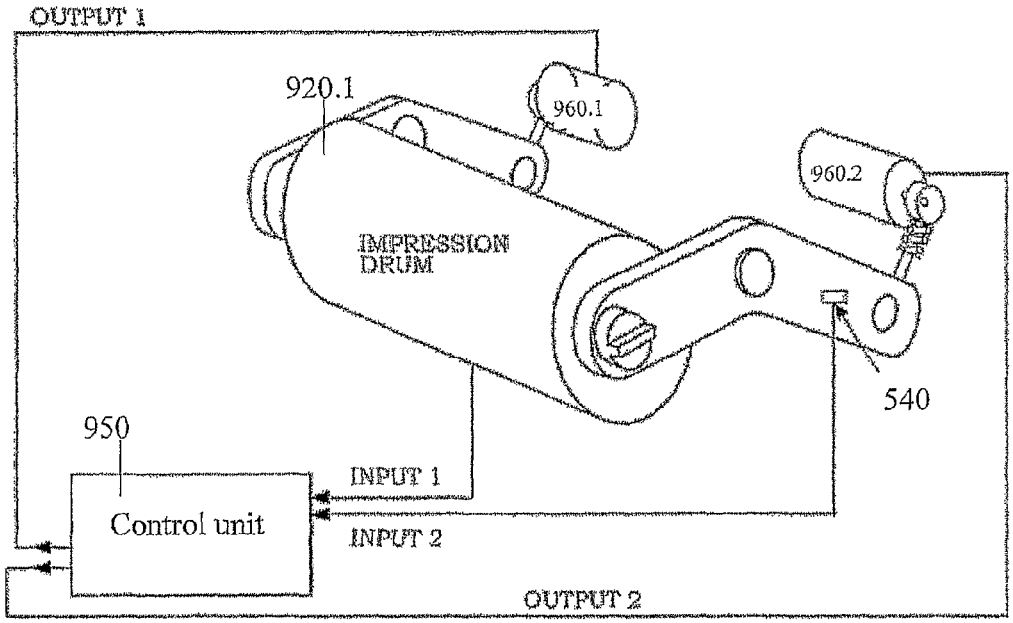
FIG. 9*b* is a simplified illustration of a printer with automatic drum spacing adjustment, according to a second exemplary embodiment of the present invention.

Reference is now made to FIG. 9*b*, which is a simplified illustration of a printer with automatic drum spacing adjustment, according to a second embodiment of the present invention. The present embodiment is directed to image transfer from the ITM drum to impression drum 920.1. Strain measurement elements 540.1 and 540.2 (strain gage 540.1 is hidden by impression drum 920.1) provide two input signals (denoted Input 1 and Input 2) to control unit 950. The input signals indicate the strain on the supporting arms of impression drum 920.1. Control unit 950 analyzes the two input signals, and derives a respective control signal (denoted Output 1 and Output 2) for each of the stepping motors, 960.1 and 960.2, in order to adjust the gap between the ITM drum and impression drum 920.1.

Figure 10:
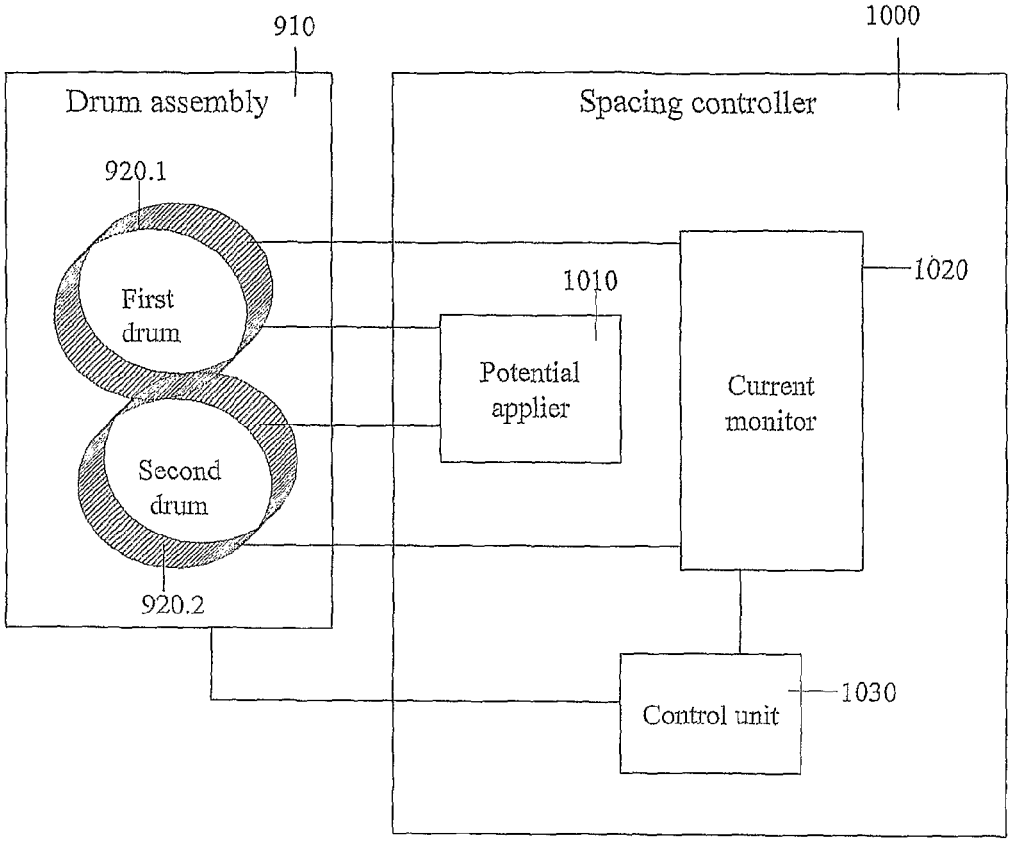
FIG. 10 is a simplified block diagram of a drum spacing controller, according to a first exemplary embodiment of the present invention.

In a further embodiment, gap adjustment based on current flow is performed by a standalone controller. Reference is now made to FIG. 10, which is a simplified block diagram of a drum spacing controller, according to a first exemplary embodiment of the present invention. The present embodiment is for controlling a drum assembly having two drums arranged for parallel rotation, and is particularly suitable for a printer having two drums arranged for image transfer by parallel rotation. Spacing controller 1000 includes potential applier 1010 which applies an electrical potential between the two drums, 920.1 and 920.2, current monitor 1020 which measures the current between the drums as the separation between them is reduced (and may also calculate the derivative of the current) and control unit 1030 that supplies control signals to the printer or drum assembly 910 so as to adjust the drum spacing. Alternately, control unit 1030 does not actively control the drums, but simply provides the operator with information for adjusting the gap.

In the present embodiment, control unit 1030 first positions the drums in an initialized position, such as with no current flow or in a "Just touch" position, and adjusts the drum positions relative to the initialized position. Alternately, control unit 1030 may position the drums so as to obtain a specified value of the derivative.

Figure 11:
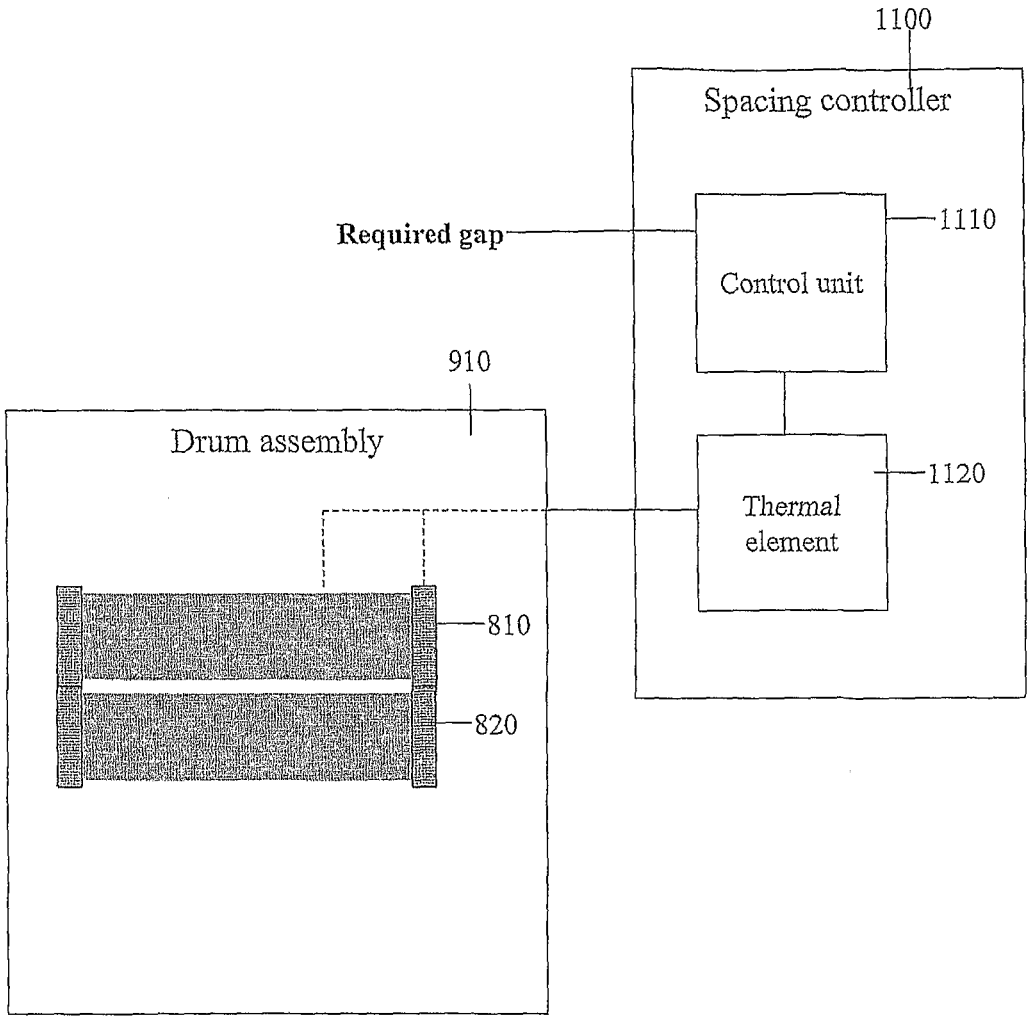
FIG. 11 is a simplified block diagram of a drum spacing controller according to a second exemplary embodiment of the present invention.

In a further embodiment, thermal control of drum spacing is performed by a standalone drum spacing controller. Reference is now made to FIG. 11, which is a simplified block diagram of a drum spacing controller according to a second exemplary embodiment of the present invention. The present embodiment is for controlling a drum assembly having two drums arranged for parallel rotation, and is particularly suitable for a printer having two drums arranged for image transfer by parallel rotation. In the present embodiment, one or both of the drums has elevated shoulders, creating a gap between the central portions of the drums. Spacing controller 1100 includes two elements, control unit 1110, for controlling drum temperature(s), and thermal element 1120. Control unit 1110 may calculate the required temperature(s) for one or both of the drums, in accordance with a specified gap between the drums. Thermal element 1120 adjusts the drum temperature(s) as indicated by control unit 1110, in order to obtain a required height difference between the shoulders and the center of the first drum. As discussed above, thermal gap adjustment may be based on either or both of creating a temperature differential between the shoulders and the center of the drum and on different thermal expansion coefficients for the shoulders and center. The thermal control element may therefore adjust the temperature of the center, shoulders, and/or blanket, as required by a specific embodiment.

In a further embodiment, the printer includes electric motors for adjusting the spacing between two print drums, where the motors are controlled by an external source.

Figure 12:
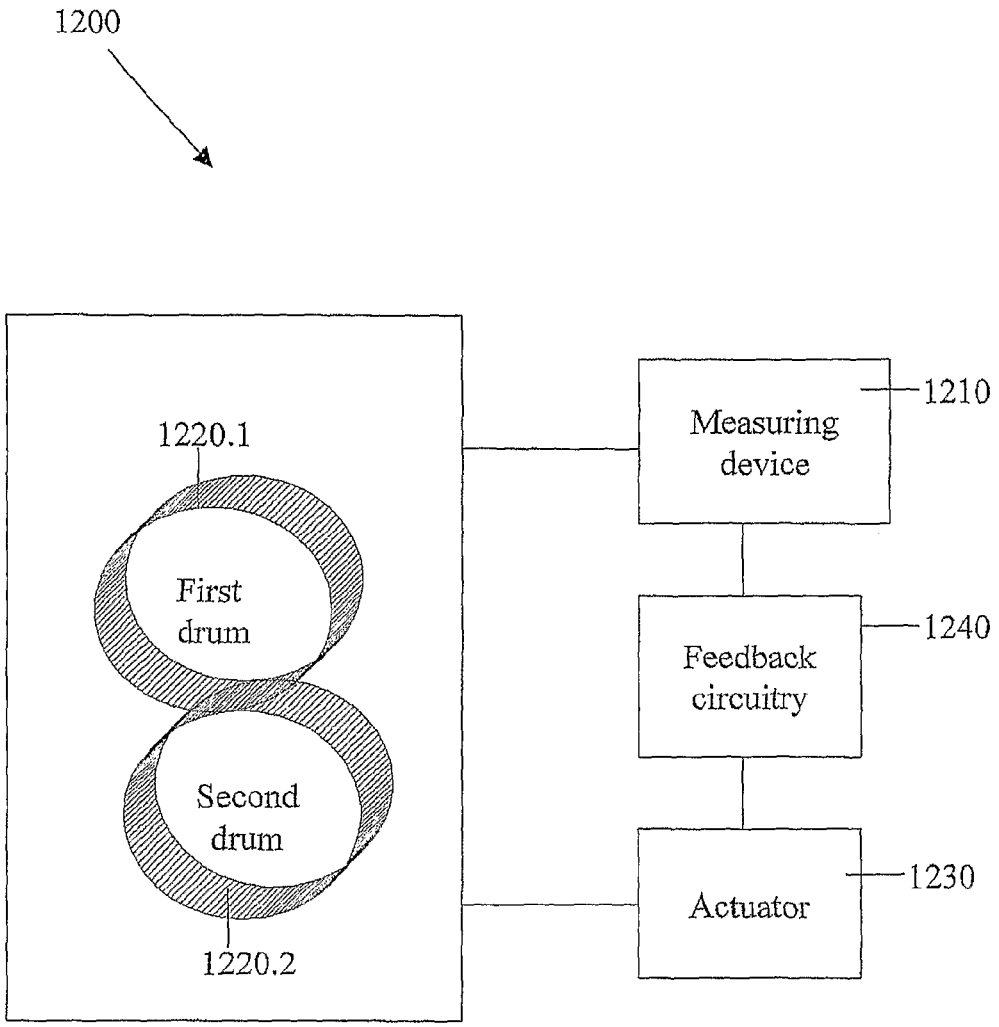
FIG. 12 is a simplified block diagram of a pressure adjustment apparatus, according to an exemplary embodiment of the present invention.

Reference is now made to FIG. 12, which is a simplified block diagram of a pressure adjustment apparatus, according to an exemplary embodiment of the present invention. The present embodiment is directed to the automatic adjustment of the pressure between two revolving drums, not necessarily in a printing system.

Pressure adjustment apparatus 1200 includes at least one pressure measuring device 1210 which is located in such a way as to provide an indicator signal indicative of the pressure between the two drums 1220.1 and 1220.2, at least one actuator 1230 which is capable of varying the pressure exerted on at least one of the drums, and feedback circuitry 1240 connected between the measuring device(s) 1210 and actuator(s) 1230. Feedback circuitry 1240 serves to receive the pressure measurements from measuring device 1210, and derives from the measurements the required change to one or both of the drums in order to obtain the desired pressure between the two drums. Feedback circuitry 1240 then outputs a control signal to actuator(s) 1230, so that actuator(s) 1230 generates the required gap and/or pressure between the drums.

Measuring device 1210 may form the indicator signal in any way known in the art. In a first embodiment, measuring device 1210 determines the contact level between the drums based on the derivative of current flow between the drums, as described for FIGS. 4 and 10. In a second embodiment, measuring device 1210 determines the contact level between the drums using one or more strain measurement elements (such as strain gages), as described for FIGS. 5 and **9*b***.

Likewise, actuator 1230 may vary the pressure between the drums in any way known in the art. In a first embodiment, actuator 1230 controls the pressure between the drums utilizing electric motors. In a second embodiment, actuator 1230 controls the pressure between the drums by thermal expansion.

The methods described above enable adjusting the printer transfer pressure to ensure high-quality printing, accurately and without operator involvement. The process is fully automatic, both for determining the required alignment and for adjusting the relative positions of the print drums, so that the adjustment can be performed along with other automatic tasks. In an electrostatic printer it is possible to adjust both the first and second transfer pressures, even during printing, and to keep the impression pressure steady during printing, without regard to blanket or paper thickness. Additionally, in contrast with previous manual methods, there is no need to print trial runs so there are no resulting material consumption costs. Furthermore, the present embodiments are implementable for many other types of systems in which the accurate control of the pressure, relative distance, and alignment of two drums is needed.

It is expected that during the life of this patent many relevant printers, print drums, print technologies, strain gages, load cells and strain measurement elements, will be developed and the scope of the corresponding terms is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A method for automatically controlling the spacing between drums of a printer, the printer comprising a first and a second drum arranged for image transfer by parallel rotation, the first drum including elevated shoulders thermally isolated from a center of the first drum, the method comprising:

obtaining an indicator signal indicative of a pressure between the first and second drums; and controlling a relative temperature of at least one of a shoulder and the center of the first drum to automatically adjust a gap between the first and second drums in accordance with the indicator signal, wherein the controlled relative temperature modifies a height difference between the shoulder and the center of the first drum to a required height difference.

2. The method of claim 1, further comprising:

separately obtaining an indicator signal at each end of the drums.

3. The method of claim 1, further comprising:

separately adjusting the gap at each end of the drums to ensure parallelism between the drums.

4. The method of claim 1, further comprising:

measuring a strain upon an arm supporting the first drum.

5. The method of claim 1, wherein said obtaining an indicator signal comprises:

applying an electrical potential between said first and second drums;

measuring a current between said drums as a separation between said drums is reduced; and calculating a derivative of said measured current.

6. The method of claim 1, wherein said adjusting a gap comprises further comprising:

mounting a respective electric motor upon each arm supporting the first drum;

forming a control signal in accordance with the indicator signal; and applying the control signal to the electric motors.

7. The method of claim 1, wherein controlling the relative temperature further comprises:

changing the drum temperature of the first drum.

8. The method of claim 1, wherein controlling the relative temperature further comprises:

changing a temperature of a blanket of one of the drums.

9. The method of claim 1, wherein controlling the relative temperature further comprises:

correlating a required temperature change based on a blanket thickness of one of the drums.

10. A printer with automatic drum spacing adjustment, comprising:

a first and a second drum arranged for image transfer by parallel rotation, wherein at least one of the drums comprises elevated shoulders thermally isolated from a center of the at least one drum;

a measurement unit, configured for obtaining an indicator signal indicative of a pressure between the drums;

a gap adjuster associated with the measurement unit, operable to adjust a gap between the drums in accordance with the indicator signal; and a thermal control element to control a relative temperature of a shoulder and a center of at least one of the drums so as to obtain a required height difference between the shoulders and the center of the at least one drum.

11. The printer of claim 10, wherein said measurement unit comprises a strain measurement element configured for strain measurement of a supporting arm of a selected one of said drums.

12. The printer of claim 10, wherein said measurement unit comprises:

a potential applier, configured to apply an electrical potential between said first and second drums; and a current monitor, configured to measure a current between said drums as a separation between said drums is reduced.

13. The printer of claim 10, further comprising two electric motors mounted respectively upon each supporting arm of one of said drums, and wherein said gap adjuster is operable to control said electric motors in accordance with said measured pressure.

14. The printer of claim 13, wherein said gap adjuster is operable to separately control each of said electric motors, so as to ensure parallelism between said drums.

15. A method for automatically controlling the spacing between drums of a printer, the printer comprising a first and a second drum arranged for image transfer by parallel rotation, the first drum including elevated shoulders and a center, and the elevated shoulders and the center having different thermal expansion coefficients, the method comprising:

obtaining an indicator signal indicative of a pressure between the first and second drums;

automatically adjusting a gap between the first and second drums in accordance with the indicator signal; and controlling a temperature of the first drum, wherein the controlled temperature modifies a height difference between the shoulders and the center of the first drum to a required height difference.

* * * * *

UNITED STATES PATENT AND TRADEMARK OFFICE

CERTIFICATE OF CORRECTION

PATENT NO. : 8,438,976 B2
APPLICATION NO. : 12/444375
DATED : May 14, 2013
INVENTOR(S) : David Levanon et al.

It is certified that error appears in the above-identified patent and that said Letters Patent is hereby corrected as shown below:

In the Claims:

In column 13, lines 25-26, in Claim 6, after "claim 1," delete "wherein said adjusting a gap comprises".

Signed and Sealed this
Twentieth Day of August, 2013

Teresa Stanek Rea
*Acting Director of the United States Patent and Trademark Office*